US006630640B1

(12) United States Patent
Schaeffeler et al.

(10) Patent No.: US 6,630,640 B1
(45) **Date of Patent: *Oct. 7, 2003**

(54) ELECTRICAL SWITCH

(75) Inventors: Alois Schaeffeler, Spaichingen (DE); Alfons Steidle, Spaichingen (DE)

(73) Assignee: Marquardt GmbH, Rietheim-Weilheim (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/959,333

(22) PCT Filed: Jun. 9, 2000

(86) PCT No.: PCT/DE00/01921

§ 371 (c)(1),
(2), (4) Date: Oct. 23, 2001

(87) PCT Pub. No.: WO00/79552

PCT Pub. Date: Dec. 28, 2000

(30) Foreign Application Priority Data

Jun. 17, 1999 (DE) ..... 199 27 628

(51) Int. Cl.[7] ..... H01H 33/02; H01H 33/08; H01H 9/30

(52) U.S. Cl. ..... 200/522; 218/147; 218/123; 218/30; 335/201

(58) Field of Search ..... 200/61.85, 520, 200/522, 304, 305, 329, 332.1, 332.2; 335/201, 202; 218/30, 32, 89, 92, 107, 108, 117, 123, 136, 146, 147, 149, 154, 155, 156

(56) References Cited

U.S. PATENT DOCUMENTS 4,149,053 A * 4/1979 Long ..... 200/522
5,012,057 A * 4/1991 Inuyama ..... 200/332.2
5,401,928 A * 3/1995 Kelley ..... 200/510
6,025,568 A * 2/2000 Schaeffeler et al. ..... 218/123

FOREIGN PATENT DOCUMENTS

DE A3 31 429 11/1963
DE A1 197 26 402 12/1998 ..... H01H/9/32
DE A2 199 30 558 1/2000 ..... H01H/5/04

* cited by examiner

*Primary Examiner*—Michael Friedhofer
(74) *Attorney, Agent, or Firm*—Venable LLP; Robert Kinberg; Cattherine M. Voorhees

(57) ABSTRACT

An electrical switch for electrical tools having an electric motor operated by a DC voltage. The switch comprises a contact system including a stationary contact and a switching contact, an operating element which acts on the switching contact to initiate a process for switching the contact system between an on-position and an off-position and a shield that quenches an arc that occurs between the stationary contact and the switching contact during the switching process. A movable slide is operatively connected to the operating element and has the switching contact arranged thereon. During the process of switching the switching contact from the on-position to the off-position, the shield is moved to an area located between the stationary contact and the switching contact. During the process of switching the switching contact from the off-position to the on-position, the shield is moved from the area located between the stationary contact and the switching contact. The shield is joined at one end to the slide, and the other end of the shield operates as a shielding element for the switching contact. The shield moves positively with the slide into and out of the area between the switching contact and the stationary contact.

10 Claims, 5 Drawing Sheets

ELECTRICAL SWITCH

BACKGROUND OF THE INVENTION

1. Field of the Invention

The present invention relates to an electrical switch for electric tools having an electric motor operated by a DC voltage.

2. Description of Prior Art

Electrical switches such as these are used in particular as mains switches for electrical handheld tools. Particularly in the case of electric motors which are operated by means of a DC voltage, for example 125 volts, heavy currents can flow, for example a direct current of 130 Amperes or more, so that an arc occurs between the contacts on switching off. The occurrence of arcs can lead to the switch being destroyed, and this must be prevented, for safety reasons, in electrical tools.

DE 197 26 402 A1 discloses an electrical switch for heavy currents, which is provided with means for quenching an arc. This switch has a contact system which comprises a stationary contact and a switching contact. An operating element acts on the switching contact in order to initiate a process for switching the contact system between an off-position and an on-position. The means, which is associated with the contact system and is in the form of a shield, for quenching any arc which occurs between the stationary contact and a switching contact during the switching process is movably coupled to the switching contact. In consequence, the shield is moved into the area located between the stationary contact and the switching contact during the process of switching the switching contact from the on-position to the off-position, and is moved out of the area located between the stationary contact and the switching contact during the process of switching the contact from the off-position to the on-position.

When switching the contact system on, the shield is moved downward, so that the shield is located underneath the stationary contact when in the on-position. A certain amount of space is therefore required there in the housing of the switch, for which purpose the housing has a bulge in this area. In some applications, particularly when there is a shortage of space available in the handle of the electrical appliance, this bulging in the switch housing may cause interference. Furthermore, the coupling between the switching content and the shield involves a complex design, resulting in the shield moving in a complicated way when switching between the off-position and the on-position. This necessitates high precision for production of the parts for the shield and, in the end, this increases the production costs for the switch.

SUMMARY OF THE INVENTION

The invention is based on the object of developing the shield further in such a manner that the switch housing can be further reduced in size.

For a switch of this generic type, this object is achieved by an electrical switch for electrical tools having an electric motor operated by a DC voltage, comprising: a contact system including a stationary contact and a switching contact; an operating element which acts on the switching contact to initiate a process for switching the contact system between an on-position and an off-position; a shield that quenches an arc that occurs between the stationary contact and the switching contact during the switching process; a movable slide being operatively connected to the operating element and having the switching contact arranged thereon; wherein, during the process of switching the switching contact from the on-position to the off-position, the shield is moved to an area located between the stationary contact and the switching contact and, during the process of switching the switching contact from the off-position to the on-position, the shield is moved from the area located between the stationary contact and the switching contact; and wherein one end of the shield is moveably associated to the slide and the other end of the shield operates as a shielding element for the switching contact, when the shield is moved to the area between the stationary contact and the switching contact.

In one preferred development, the shield is in the form of a two-armed lever element. The first lever arm of the lever element is articulated on the slide, and the second lever arm is associated with the switching contact, as the actual shielding element. The two-armed lever element may be approximately C-shaped or sickle-shaped. The switch housing may comprise a housing lower part for holding the slide, the contact system and the like, and the housing upper part in the nature of a cover. In this case, the rotation part of the two-armed lever, may be mounted in the interior of the housing, in particular on the housing lower part.

In order to articulate the shield on the slide, a guide link is located in the slide and/or in an attachment arranged on the slide. A bolt which is fitted to the first lever on the shield engages in the guide link in such a manner that the shield can be moved positively with the slide. The guide link may comprise a first guide surface, facing the switching contact, and a second guide surface, which is adjacent to it and faces away from the switching contact. The first guide surface is in the form of an inclined plane, which runs obliquely with respect to the movement direction of the slide, while the second guide surface runs approximately in the direction of movement of the slide. Overall, the guide link is approximately boomerang-shaped. This type of articulation ensures precise positive guidance between the slide and the shield.

The housing lower part has a recess for holding at least one part of the second lever arm of the shield when the contact system is in the on-position. Furthermore, the recess is also used for holding part of the first lever arm of the shield when the contact system is in the off-position. At least one side surface can be arranged on the second lever arm, which acts as the shielding element, in such a manner that the shielding element forms a type of cap. The cap then largely covers that surface of the switching contact which faces the stationary contact in the off-position. This refinement reliably prevents the arc from escaping sideways.

In one preferred refinement, the switch according to the invention has a contact system with two stationary contacts and one switching contact which is in the form of a bridging contact and is provided with two contact surfaces. The shield comprises two lever elements which are arranged alongside one another and are associated with the respective contact surface. The two lever arms of the lever element of the shield can be connected to one another at their rotation point via a common shaft. The shaft expediently has ends which project at the rotation point of the lever element, with the two ends of the shaft each being mounted in a holder in the housing lower part such that they can rotate. Furthermore, two mutually opposite attachments can be arranged on the slide, each having a guide link, in such a manner that the bolt on the first lever arm of each lever element engages in the guide link.

The advantages achieved by the invention are, in particular, that the switch is reliably protected against its contact system being destroyed by the influence of arcs. Any arc which may occur is quenched within a short time, thus effectively preventing erosion of the contacts in the contact system. The life of the switch is thus considerably increased.

The electrical switch is particularly suitable for heavy currents and can thus be used in high-powered electrical tools. In particular, the switch can be used for electric motors which are operated with DC voltage, where, in contrast to the situation at the zero crossing of an AC voltage, the arc is not automatically quenched. The switch can also be used as a brake switch for electrical tools that use short-circuit breaking, where particularly large direct currents occur on switching off, due to the electric motor being short-circuited and acting as a generator.

BRIEF DESCRIPTION OF THE DRAWINGS

Nevertheless, the switch is compact and physically small overall, and it is thus particularly suitable for narrow, ergonomic handles on electric tools. In addition, the shield has a simple design so that no particular precision is required for producing the parts for the shield. Furthermore, only a small number of additional parts are required for the switch, while its functionality is improved. In consequence, only minor additional production costs are incurred for the switch, despite its performance being improved.

An exemplary embodiment of the invention, together with developments, will be described in more detail in the following text and is illustrated in the drawings, in which.

DETAILED DESCRIPTION OF THE PREFERRED EMBODIMENTS

Figure 1:
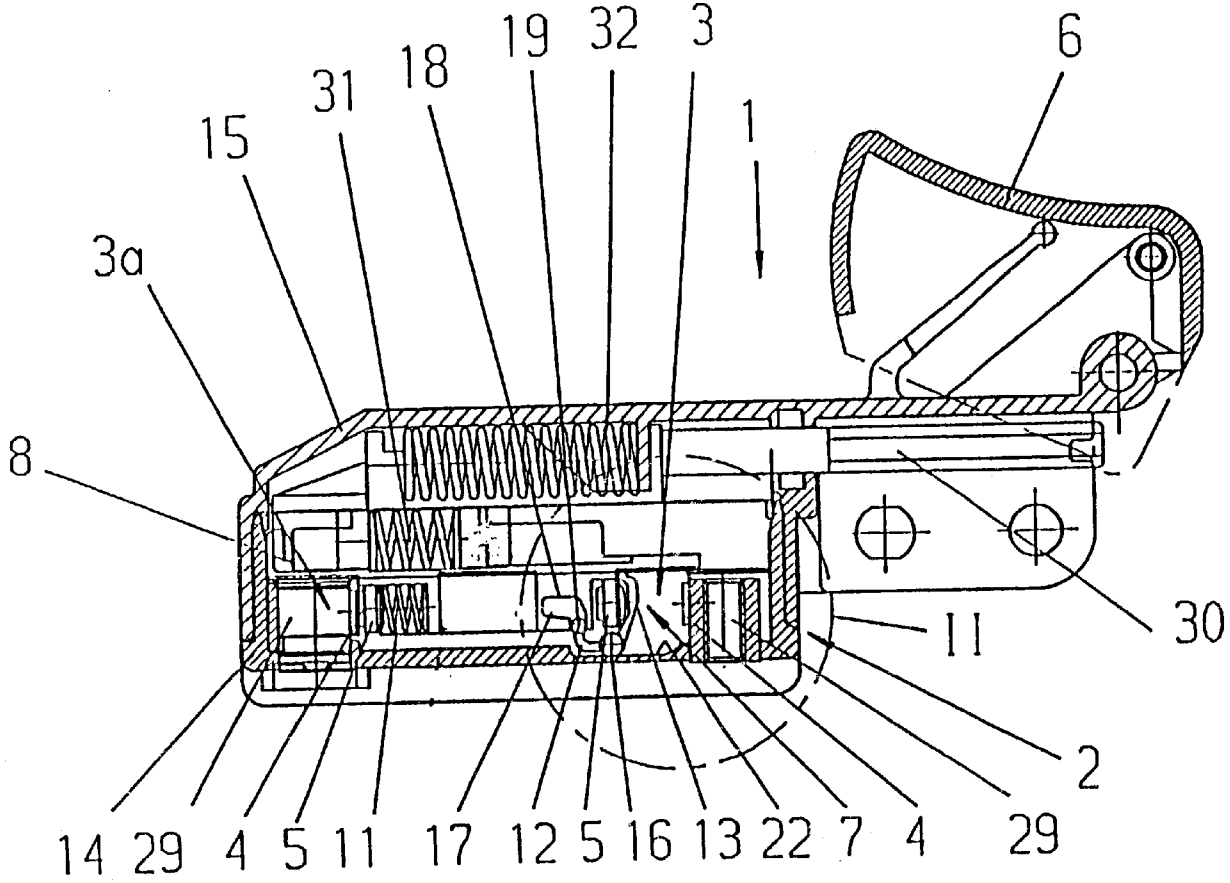
FIG. 1 shows a longitudinal section through an electrical switch, with the contact system being in the off-position.

FIG. 1 shows an electrical switch 1 which can be used as a mains switch in an electrical handheld tool, such as an angle grinder, a drill, a circular saw or the like. The electrical handheld tool contains an electric motor which is operated, for example, by means of direct current.

Figure 5:
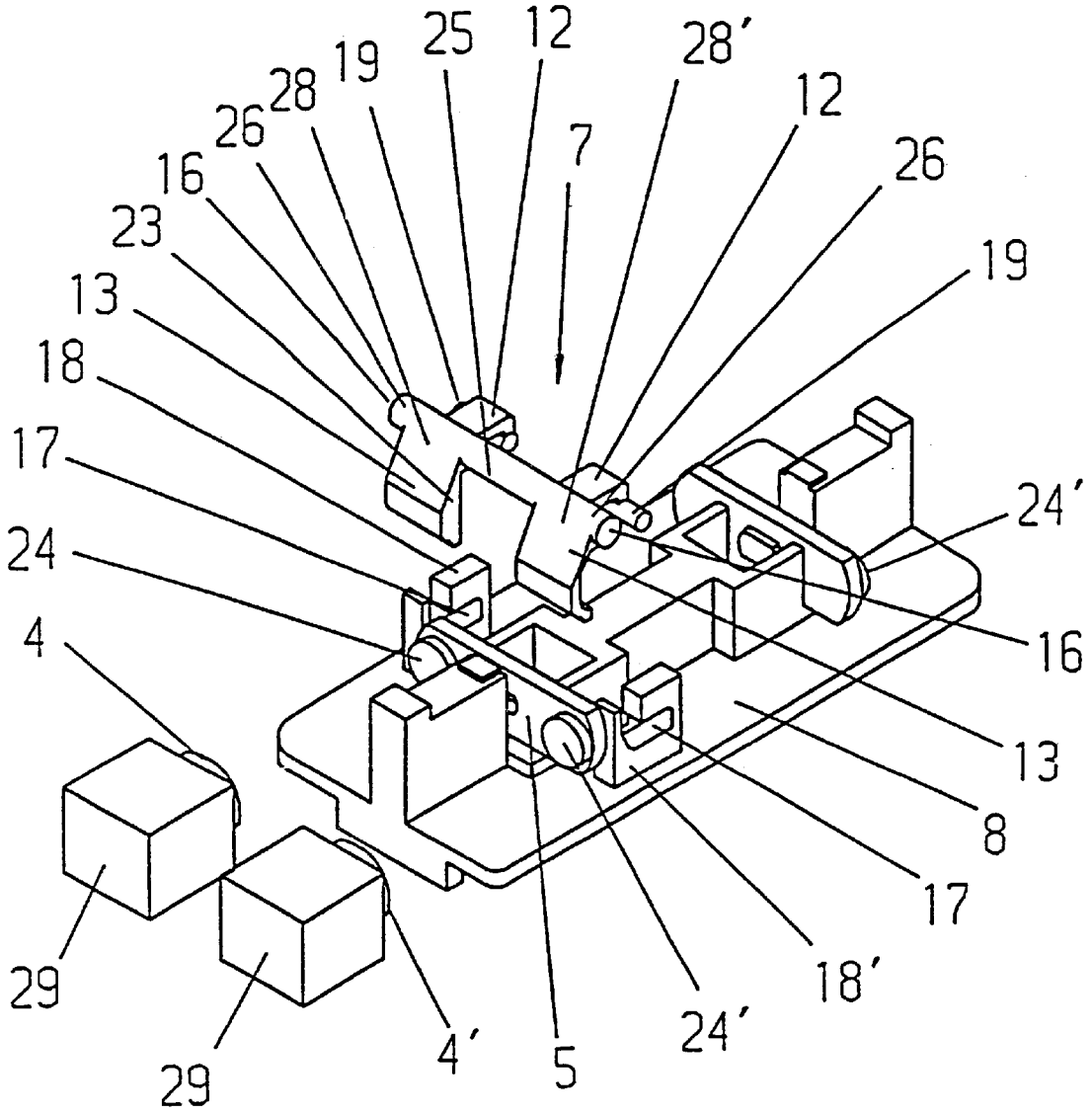
FIG. 5 shows the slide with the shield as an individual part, as a perspective view seen from underneath.

The switch 1 has a housing 2 which comprises a housing lower part 14 in the nature of a base, and a housing upper part 15 in the nature of a cover. At least one contact system 3 is arranged in the interior of the housing 2. This switch 1 contains two contact systems 3, 3*a*, for switching two current paths. The contact system 3, 3*a* comprises a stationary contact 4, which is fitted to an electrical connection 29 that is used for connection to electrical supply lines in the electrical tool, and a switching contact 5. In particular, in a switch 1 such as this, the contact system 3, 3*a* may in each case have two fixed contacts 4, 4' and a switching contact 5 which is in the form of a bridging contact and is provided with two contact surfaces 24, 24', as can be seen in FIG. 5.

Figure 3:
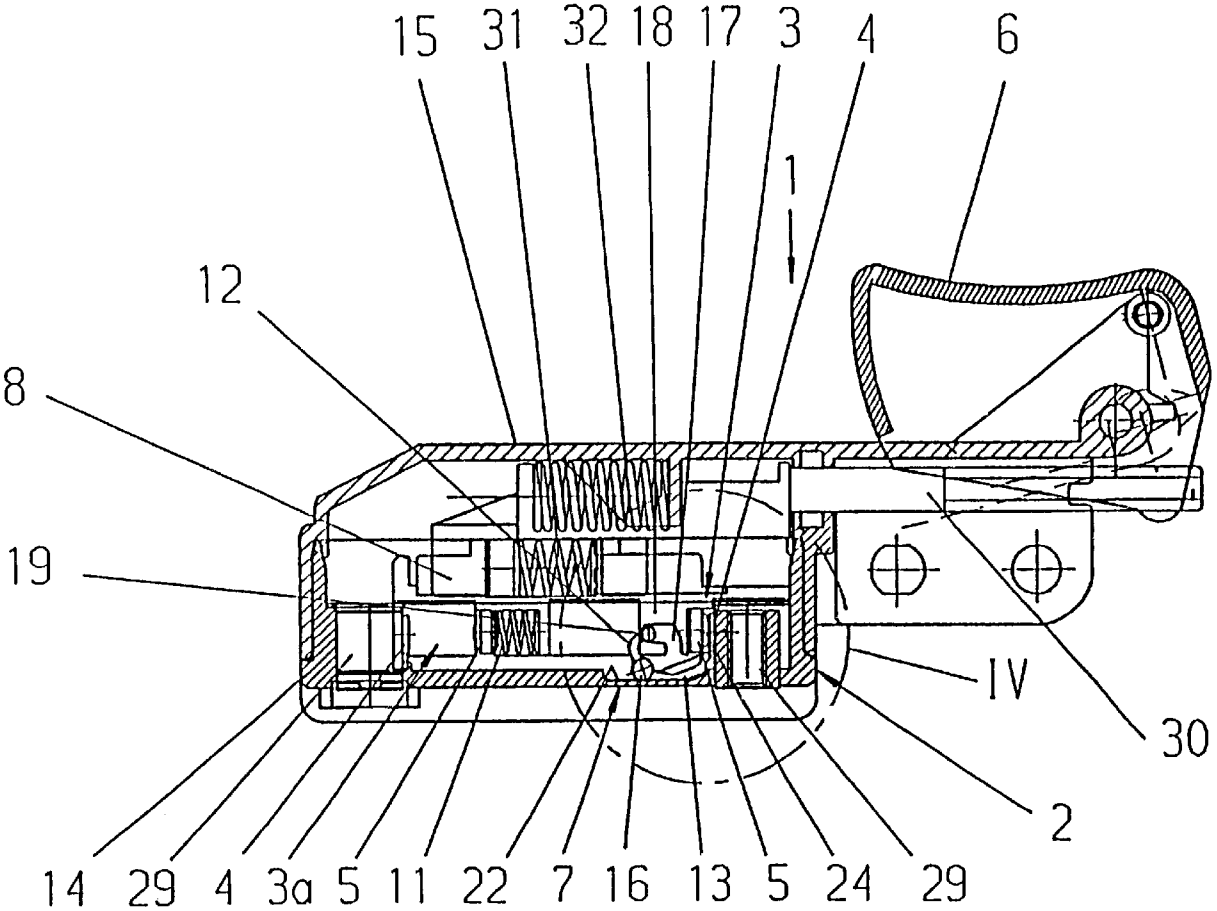
FIG. 3 shows a longitudinal section through the electrical switch, with the contact system being in the on-position.

An operating element 6, arranged on the housing 6, acts on the switching contact 5 in order to initiate the process of switching the contact system 3, 3*a* from an off-position to an on-position. For this purpose, the operating element 6 is operatively connected to a slide 8 which is located in the housing 2 and can be moved essentially linearly, in that a plunger 30, which projects out of the housing 2, of the slide 8 is articulated on the operating element 6. The slide 8, the contact system 3, 3*a* and, possibly further parts of the switch 1 are held in the housing lower part 14. The slide 8 and the plunger 30 contain springs 31, 32 and another pressure-point spring, which is not shown, so that the slide 8 switches in the form of a snap-action movement between the two positions of the contact system 3, 3*a*. For its part, the switching contact 5 is arranged with an elastic element 11 on the lower face of the slide 8, as can be seen in FIG. 1 or 3. The configuration of the operative connection between the slide 8 and the operating element 6 is described in more detail in DE 199 30 558 A1 from the same applicant, which was not published prior to this and is itself based on the priority of German Patent Application DE 198 33 296.3, so that any further description is superfluous at this point.

Figure 4:
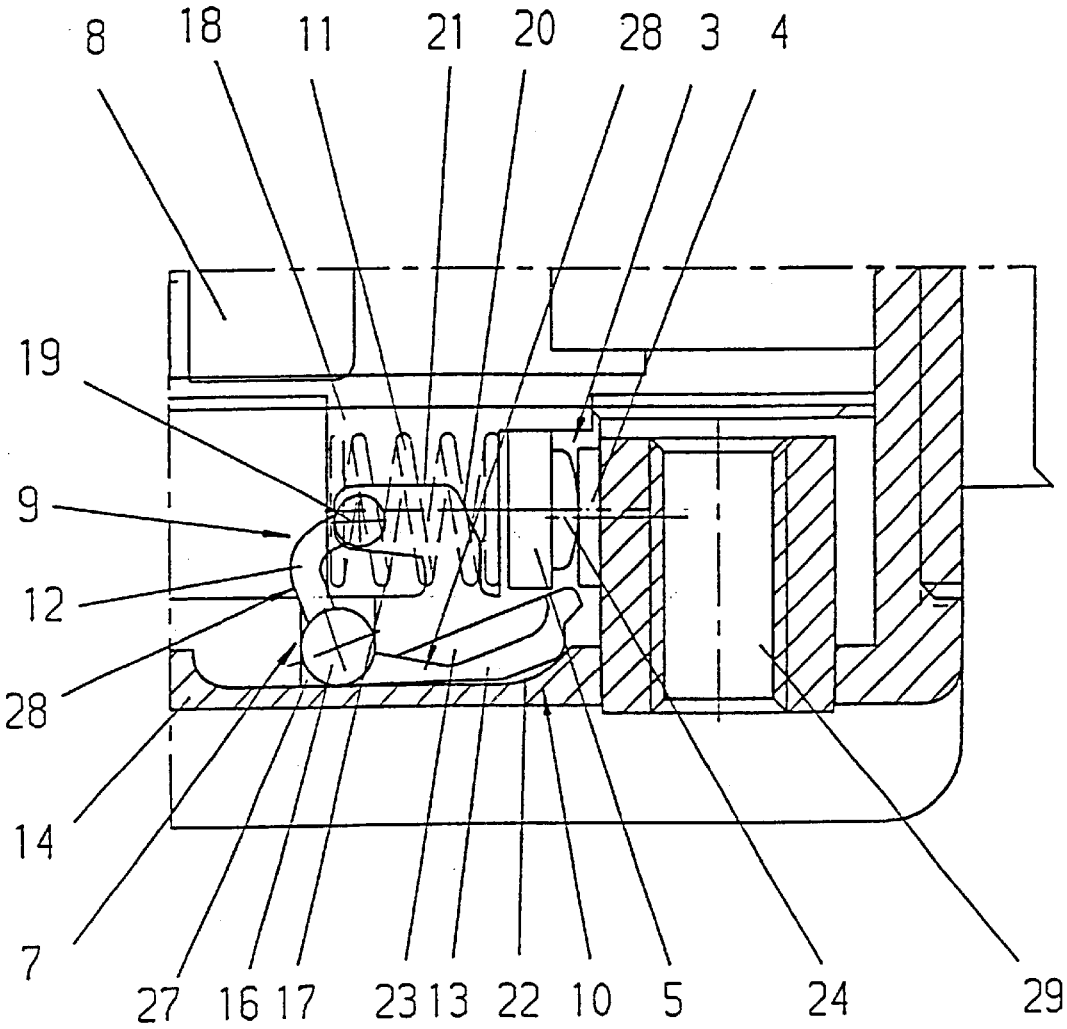
FIG. 4 shows an enlarged detail of the contact system as in FIG. 2, with the contact system being in the on-position, corresponding to the region IV in FIG. 3.

The following text will consider only the contact system 3 in more detail, with respect to the invention. The contact system 3 can be seen in the off-position in FIGS. 1 and 2, in which the switching contact 5 is at a distance from the stationary contact 4. FIG. 3 and FIG. 4 show the contact system 3 in the on-position, in which the switching contact 5 and the stationary contact 4 are in contact. As can be seen in particular from FIG. 4, the elastic element 11 then exerts a force pressing the switching contact 5 against the stationary contact 4.

When operating high-power electric motors, correspondingly heavy currents flow via the contact system 3 of the switch 1 when it is in the on-position. For example, a direct current of up to approximately 120 Amperes can flow in angle grinders whose power is 2.3 kilowatts. When the electric motor is switched off, that is to say when the contact system 3 is switched to the off-position, an arc is then struck between the switching contact 5 and the stationary contact 4, and this can lead to contact erosion. In order to avoid destruction of the contact system 3, the contact system 3 has associated means, which are in the form of a shield 7, for quenching any arc which occurs between the stationary contact 4 and the switching contact 5 during the switching process.

Figure 2:
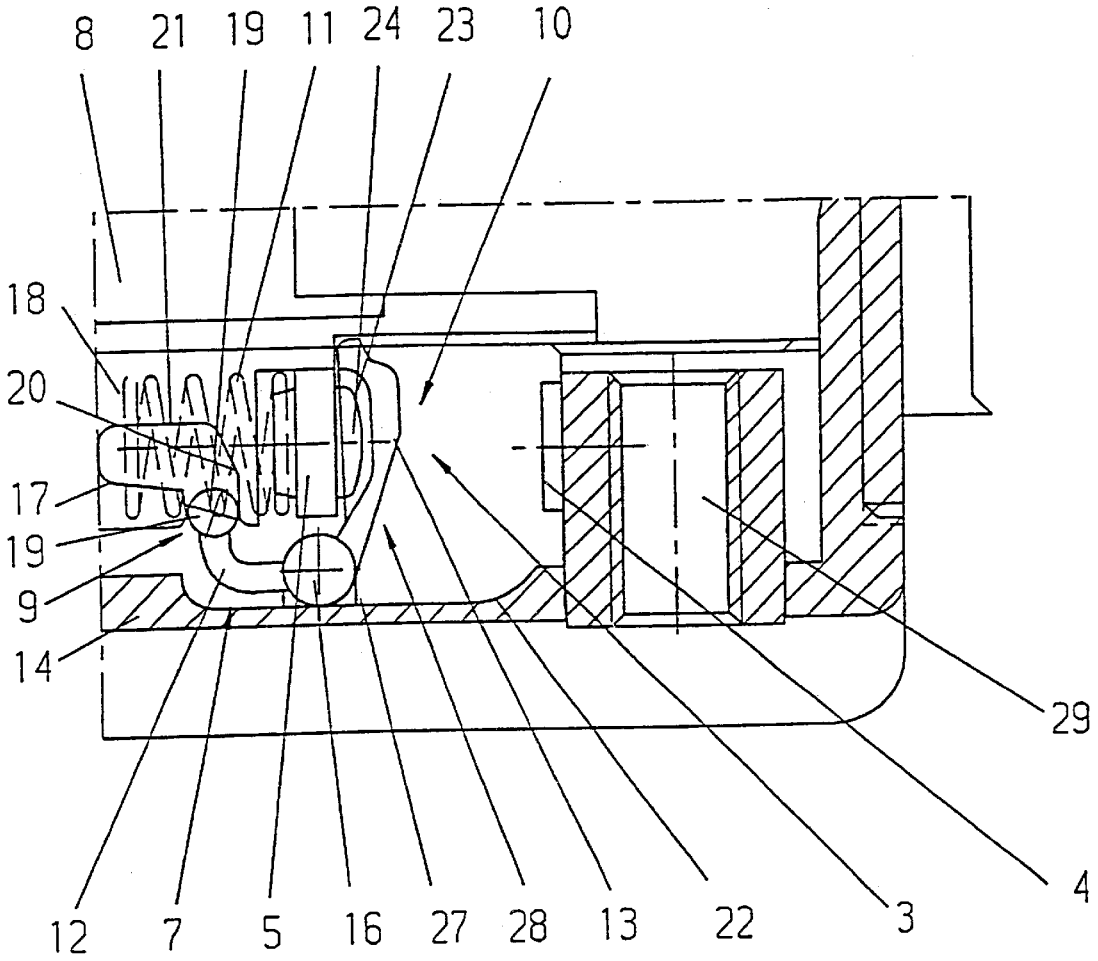
FIG. 2 shows an enlarged detail of the contact system corresponding to the region II shown in FIG. 1.

The shield 7 is coupled to the switching contact 5 such that it can move. As can be seen in FIG. 2 or 4, one end 9 of the shield 7 is articulated on the slide 8 for coupling, and the other end 10 is associated with the switching contact 5, as the shielding element. This coupling results in the shield 7 moving into the area located between the stationary contact 4 and the switching contact 5 during the process of the switching contact 5 from the on-position shown in FIG. 4 to the off-position shown in FIG. 2, so that the arc is displaced or interrupted, and is finally quenched. During the opposite process when the switching contact 5 is switched from the off-position shown in FIG. 2 to the on-position corresponding to FIG. 4, the shield 7 is moved out of the area located between the stationary contact 4 and the switching contact 5. Since the shield 7 is then located outside this area between the switching contact 5 and the stationary contact 4, the switching contact 5 can make contact with the stationary contact 4 without any impediment in the on-position.

More details of the configuration of the shield 7 can be seen in FIG. 2 or 4. The shield 7 is in the form of a two-armed lever element 28. The two-armed lever element and the shield 7 is preferably approximately C-shaped or sickle-shaped like a toggle lever. The one, first lever arm 12 is articulated on the slide 8, while the other, second lever arm 13 is associated with the switching contact 5, as the actual shielding element. At least one side surface 23 can be arranged on the second lever arm 13, which acts as the shielding element, and this can be seen particularly clearly in FIG. 4, so that the shielding element then forms a type of cap. This cap largely covers that contact surface 24 of the switching contact 5 which faces the stationary contact 4 in the off-position, corresponding to FIG. 2, whilst preventing the arc from escaping sideways. The rotation point 16 of the two-armed lever element 28 of the shield 7 is mounted in a holder 27, such that it can rotate, in the interior of the housing 2, to be precise on the housing lower part 14.

The configuration of the articulation of the shield 7 on the slide 8 can likewise be seen in more detail in FIG. 2 or 4. For this purpose, the slide 8 has a guide link 17, which may be located in an attachment 18, which is arranged on the slide 8 and can be seen in FIG. 5. The guide link may also be located directly in the slide 8, of course, but this is not shown in any more detail. A bolt 19 which is fitted on the first lever arm 12 of the shield 7 engages in the guide link 17 in such a manner that the shield 7 can be moved positively with the slide 8. The guide link 17 itself comprises a first guide surface 20, which faces the switching contact 5 and is in the form of an inclined plane, and a second guide surface 21, which is adjacent to it and faces away from the switching contact 5. The first guide surface 20 runs essentially obliquely with respect to the movement direction of the slide 8, while the second guide surface 21 runs approximately in the direction of movement of the slide 8. The guide link 17 is thus approximately boomerang-shaped.

The housing lower part 14 has a recess 22, which can be seen in FIGS. 1 to 4. The recess 22 is used to hold at least one part of the second lever arm 13, which is in the form of a shielding element of the shield 7 when the contact system 3 is in the on-position, as can be seen in FIG. 4. Furthermore, as can be seen in FIG. 2, the recess 22 is also used to hold a part of the first lever arm 12 of the shield 7 when the contact system 3 is in the off-position.

If the switching contact 5 is provided with two contact surfaces 24, 24' as the bridging contact, then it is possible for the shield 7 to be composed of two lever elements 28, 28', which are arranged alongside one another and are associated with the respective contact surface 24, 24'. Such a configuration is shown in more detail in FIG. 5, as an exploded illustration of the slide 8 and the shield 7. The two lever elements 28, 28' are connected to one another at their rotation point 16 via a common shaft 25. The shaft 25 furthermore has ends 26 which project at the rotation point 16 of the lever elements 28, 28', with the two ends 26 of the shaft 25 each being mounted such that they can rotate in a holder 27, which is indicated in FIG. 2 or 4, in the housing lower part 14. Two mutually opposite attachments 18, 18' are arranged on the slide 8 and each have a guide link 17, in such a manner that the bolt 19 on the first lever arm 12 of each lever element 28, 28' engages in the guide link 17. The two lever elements 28, 28' are thus positively guided at the same time during movement of the slide 8, and their second lever arms 13 act in the manner described above as shielding elements for the two contact surfaces 24, 24' of the switching contact 5, in order to interrupt the arc.

The invention is not restricted to the exemplary embodiment which has been described and illustrated. In fact, it also covers all specialist developments within the scope of the idea of the invention. The invention can thus be used not only, for switches for electrical tools but also for switches for controllers, for example in the field of motor vehicles or the like.

What is claimed is:

1. An electrical switch for electrical tools having an electric motor operated by a DC voltage, comprising:

a contact system including a stationary contact and a switching contact;

an operating element which acts on the switching contact to initiate a process for switching the contact system between an on-position and an off-position;

a shield that quenches an arc that occurs between the stationary contact and the switching contact during the switching process;

a movable slide being operatively connected to the operating element and having the switching contact arranged thereon;

wherein, during the process of switching the switching contact from the on-position to the off-position, the shield is moved to an area located between the stationary contact and the switching contact and, during the process of switching the switching contact from the off-position to the on-position, the shield is moved from the area located between the stationary contact and the switching contact; and wherein one end of the shield is moveably associated to the slide, and the other end of the shield operates as a shielding element for the switching contact, when the shield is moved to the area between the stationary contact and the switching contact.

2. An electrical switch according to claim 1, wherein the slide is located in a housing of the switch and moves substantially linearly, and when the contact system is in the on-position, an elastic element arranged in the slide exerts a force pressing the switching contact against the stationary contact.

3. An electrical switch according to claim 1, wherein the shield is in the form of a two-armed lever element, with the first lever arm being joined to the slide, and the second lever arm being associated with the switching contact as the actual shielding element.

4. An electrical switch according to claim 3, wherein the two-armed lever element is substantially C-shaped or sickle-shaped.

5. An electrical switch according to claim 3, wherein the housing of the switch comprises a housing lower part in the form of a base for holding at least the slide and the contact system and a housing upper part in the form of a cover, so that a rotation point of the two-armed lever element is mounted on the housing lower part in the interior of the housing.

6. An electrical switch according to claim 5, wherein the housing lower part has a recess for holding at least one part of the second lever arm when the contact system is in the on-position and for holding a part of the first lever arm when the contact system is in the off-position.

7. An electrical switch according to claim 3, wherein a guide link is located in at least one of the slide and an attachment arranged on the slide, and a bolt is fitted to the first lever arm of the shield for engaging in the guide link and joining the shield to the slide, so that the shield moves positively with the slide.

8. An electrical switch according to claim 7, wherein the guide link comprises a first guide surface, which faces the switching contact, is in the form of an inclined plane and runs substantially obliquely with respect to a direction of a movement of the slide, and a second guide surface, which is adjacent to the first guide surface, faces away from the switching contact and runs substantially in the direction of the movement of the slide, the guide link being substantially boomerang-shaped.

9. An electrical switch according to claim 1, wherein at least one side surface is formed on the second lever arm, so that, when the contact system is in the off-position, the shielding element forms a cap, which largely covers a contact surface of the switching contact that faces the stationary contact.

10. An electrical switch according to claim 1, wherein the contact system comprises two stationary contacts and one switching contact, the switching contact being in the form of a bridging contact and being provided with two contact surfaces, and the shield comprises two lever elements which are arranged alongside one another and are associated with a respective one of the contact surfaces, the two lever elements being connected to one another at a rotation point via a common shaft, the shaft having two ends that project at the rotation point of the lever elements, each of the two ends of the shaft being mounted in a holder in a lower part of a housing such that the two ends rotate, the slide having two mutually opposite attachments arranged thereon, each of the mutually opposite attachments having a guide link where a bolt on a first lever arm of each of the two lever elements engages in the guide link.

* * * * *